United States Patent [19]

Bennett et al.

[11] Patent Number: 5,061,459

[45] Date of Patent: Oct. 29, 1991

[54] PREVENTION OF COPPER DISSOLUTION DURING CYANIDATION OF GOLD ORES

[75] Inventors: Charles A. Bennett, Staines; Elizabeth A. Crathorne, Berkshire; Raymond Edwards, Hayes, all of England

[73] Assignee: The British Petroleum Company p.l.c., London, England

[21] Appl. No.: 428,277

[22] Filed: Oct. 27, 1989

[51] Int. Cl.[5] ..... B01D 11/02; C22B 11/08

[52] U.S. Cl. ..... 423/29; 423/32

[58] Field of Search ..... 423/22, 26, 29, 30, 423/31, 32; 209/166; 75/737

[56] References Cited

U.S. PATENT DOCUMENTS

| | | | |
|---|---|---|---|
| 1,461,807 | 7/1923 | Silver | 423/29 |
| 1,519,396 | 12/1924 | Darrow | 423/29 |
| 1,549,856 | 8/1925 | Darrow | 423/29 |
| 1,864,222 | 5/1932 | Swainson et al. | 209/166 |
| 2,839,387 | 6/1958 | Burton | 423/29 |
| 4,441,993 | 4/1984 | Howald | 209/166 |
| 4,908,125 | 3/1990 | Mackenzie et al. | 209/166 |

FOREIGN PATENT DOCUMENTS

| | | | |
|---|---|---|---|
| 1100239 | 4/1981 | Canada | 209/166 |
| 174866 | 3/1986 | European Pat. Off. | 209/166 |
| 3801741 | 6/1989 | Fed. Rep. of Germany | 423/29 |
| 2197657 | 5/1974 | France | 423/26 |

*Primary Examiner*—Michael L. Lewis
*Assistant Examiner*—Peter T. DiMauro

[57] ABSTRACT

A process for treating copper containing precious metal ores prior to cyanidation and recovery of the precious metal eg gold. The process involves addition to the ore before or after milling of a water soluble or water dispersible surface active agent in the form of a fatty alkyl amine preferably an ethoxylated fatty alkyl amine. The agent reduces the high cyanide consumption, which is caused by copper dissolution, by passivating the mineral surface.

8 Claims, No Drawings

PREVENTION OF COPPER DISSOLUTION DURING CYANIDATION OF GOLD ORES

This invention relates to a method for treating copper-containing precious metal ores, particularly gold ores from which the precious metal is to be recovered by cyanidation, to reduce the deleterious effect of the copper on the overall precious metal winning process.

Precious metals, particularly gold, can be recovered from milled ores containing them by treatment with an alkaline cyanide solution, the precious metal going into the solution as a cyanide salt. In the case of gold the reaction can be represented as:

$$4Au + 8NaCN + O_2 + 2H_2O \rightarrow 4NaAu(CN)_2 + 4NaOH$$

The precious metal can then be recovered from the solution by precipitation onto zinc dust or by adsorption onto activated carbon.

The ore may, however, contain other metals, e.g. iron, copper, nickel, and zinc, which are also liable to form cyanide salts. Such competition can complicate and increase the cost of the precious metal winning process in a number of ways. It can reduce the amount of precious metal recovered, increase the consumption of cyanide, and reduce the purity of the recovered precious metal. The barren cyanide solution (i.e. the solution remaining after the precious metal has been recovered) is normally recycled to maximise cyanide utilisation and it may be necessary to bleed off a portion of this recycle stream to prevent a build-up of copper in the system. This bleed stream then has to be treated to remove the copper before it can be re-used or, if it is to be disposed of, it has to be treated to meet the stringent limits for effluent disposal.

Existing methods for dealing with the problem of copper all involve pretreatment of the ore to remove copper before cyanidation. This can be done either by floating off the copper mineral (for example, chalcopyrite) or by acid or alkaline leaching. This, of course, adds to the overall cost of the process.

The present invention is based on the finding that the deleterious effect of copper containing minerals can be reduced by a form of passivation pre-treatment during or prior to cyanidation. The copper is not removed but passes through the cyanidation process with a reduced tendency to form cyanide complexes.

According to the present invention there is provided a process for the treatment of precious metal containing ores, which contain cyanide consuming copper minerals, during or prior to cyanidation and recovery of the precious metal, the process comprising adding to the ore during or after milling a water-soluble or water-dispersible fatty alkyl amine.

The fatty alkyl amine should be one of or a blend of primary, second or tertiary amines although quaternary amines may be used in blends with one or more primary, secondary or tertiary amines.

Preferred surface active agents are ethoxylated fatty alkyl amines. Examples include compounds of the types:

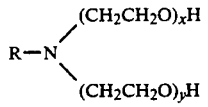

(i)

-continued

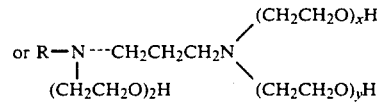

where x and y are integers and preferably $x+y=2$

The quantity of surface active agent required will depend on the amount of cyanide consuming copper minerals in the ore and the optimum quantity to reduce copper dissolution during cyanidation at a reasonable cost can readily be determined by experiment. The quantities can, however, be relatively modest in relation to the amount of ore processed, e.g. from 0.01–1 kg of surface active agent/tonne of ore.

The surface active agent should be water-soluble or dispersible so as not to complicate the cyanidation process which uses an aqueous solution.

Precious metal containing ores are normally milled prior to cyanidation to encourage precious metal extraction. Typical particle sizes for the milled ore may be from 1 to 500 microns. The surface-active agent may be added to the ore before or during this milling process or it may be added to the milled ore with suitable agitation to ensure good contact between the copper mineral and the surface active agent. The surface active agent is added as an aqueous solution or dispersion. With addition of agent during or after milling an excess of solution may be used and the excess subsequently removed by filtration, but it has been found that this complication is not essential and that satisfactory results can be obtained simply by grinding or mixing the ore with the required amount of solution to give the required quantity of agent per tonne of ore. If it is required to grind the ore with cyanidation agent then the presence of the surface active agent will not affect the gold extraction.

The milled ore containing the surface active agent can be processed by cyanidation in conventional manner. No major changes in the cyanidation technique are necessary as a result of the presence of the agent. In addition to the benefits of reduced copper extraction and lower cyanide consumption, there is an increase in the solids settling rate indicating that the surface active agent improves particle aggregation and also the possibility of increased gold extraction.

The treatment process is not limited to the use of a milling stage but also could be used during a heap leaching process.

The invention is illustrated by the following Examples.

Table 1 shows a range of surface active agents used to treat precious metal containing ores which also contain cyanide consuming copper minerals. The Ethomeen reagents are a group of ethoxylated alkyl amines of structure

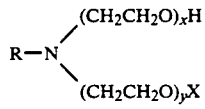

where $x+y=2,5$ and 15 for reagents designated 12,15 and 25 respectively i.e. in order of increasing ethoxylation and were supplied by Akzo Chemie. Ethoduomeen and Armeen O were also supplied by Akzo Chemie and the Duoteric reagent was supplied by ABM Chemicals.

All the reagents were tested as a 0.1% aqueous solution/dispersion with the exceptions of Armeen O and Duoteric. Armeen O was prepared as an isopropanol (10%)-water dispersion. Duoteric H12 is supplied as an aqueous isopropanol solution and was diluted with water to the required concentration.

The ores used in the tests were sulphidic gold containing ores from the Hope Brook mine in Canada. The copper content of the samples ranged from 0.42 wt % (HB/M) to 0.05 wt % (HB78). The sample used in Table 2 was HB/M of copper content 0.42 wt % as chalcopyrite. Table 3 shows assays of the major elements in the ore samples.

All the ore samples were wet ground in a 5 L rod mill at 60% wt solids to give a particle size of 80% less than 75 microns. The samples were milled with and without added surface active agent as shown in Table 2.

With each sample the mill was discharged into a glass bottle with enough water to reduce the pulp density to 30–35% wt solids. The pH was adjusted to 11 to 11.5 by the addition of calcium hydroxide, sodium cyanide (equivalent to 1.8 kg/t ore) added and the bottle agitated on rollers for 72 h. The pulp was then filtered and washed, the filtrate and washings being analysed for gold and copper by atomic absorption spectroscopy. Residual free cyanide in the solution was analysed using an ion selective electrode. The residue from the test was dried and analysed for gold by fire assay, the percentage gold extraction being based on the solution and residue assays.

It will be seen that the use of the surface active agents resulted in one or more of increased gold extraction, reduced copper extraction or reduced sodium cyanide consumption. The reduction in sodium cyanide consumption was greater than that attributable to the reduction in copper extraction. While not wishing to be bound by any theory, this appeared to be partly due to reduced thiocyanate formation, possibly resulting from coverage of the copper sulphide surfaces with the agent.

The improvement in gold extraction may also be, at least in part, due to the surface active agent passivating a possible gold cyanide ($Au(CN)_2^-$) adsorbing component of the ore.

It appears that the copper passivation is improved with lower degrees of amine ethoxylation and longer alkyl chain lengths. However, amines having longer chain lengths tend to be more viscous and hence less easy to pump and handle.

Also non-ethoxylated amines such as Duoteric H12 and Armeen O are effective in copper passivation and at higher concentrations are of similar effectiveness to ethoxylated amines.

TABLE 1

| Trade Name | Chemical Name | Typical alkyl chain distribution $C_{10}$ | $C_{12}$ | $C_{14}$ | $C_{16}$ | $C_{18}$ | $C_{20}$ | Appearance at 25° C. | Tested as |
|---|---|---|---|---|---|---|---|---|---|
| Ethomeen C/12 | Cocobis(2-hydroxyethyl)amine | 3 | 58 | 22 | 10 | 7 | | Liquid | Dispersion |
| Ethomeen C/15 | Polyoxyethylene cocoamine | 3 | 58 | 22 | 10 | 7 | | Liquid | Solution |
| Ethomeen C/25 | Polyoxyethylene cocoamine | 3 | 58 | 22 | 10 | 7 | | Liquid | Solution |
| Ethomeen T/12 | Tallow bis(2-hydroxyethyl)amine | | 1 | 4 | 31 | 64 | tr. | Liquid/paste | Dispersion |
| Ethomeen T/15 | Polyoxyethylene tallowamine | | 1 | 4 | 31 | 64 | tr. | Liquid | Solution |
| Ethomeen T/25 | Polyoxyethylene tallowamine | | 1 | 4 | 31 | 64 | tr. | Liquid | Solution |
| Ethomeen S/12 | Oleylbis(2-hydroxyethyl)amine | | 1 | 4 | 12 | 82 | tr. | Heavy Liquid | Dispersion |
| Ethomeen S/15 | Polyoxyethylene oleylamine | | 1 | 4 | 12 | 82 | tr. | Liquid | Solution |
| Ethomeen S/25 | Polyoxyethylene oleylamine | | 1 | 4 | 12 | 82 | tr. | Liquid | Solution |
| Ethoduomeen | $N,N^1,N^1$-tris(2-hydroxyethyl)-N-tallow-1,3-diamino-propane | | 1 | 4 | 31 | 64 | tr. | Liquid | Solution |
| Duoteric H12 | Blend of quaternary and tertiary amines | | | Not available | | | | Liquid | Aq. iso-propanol solution |
| Armeen O | Oleylamine (95% primary amine) | | | Not available | | | | Paste | Aq. iso-propanol solution |

tr = trace

TABLE 2

| Reagent (kg/t) | Gold Extn (%) | Copper Extn (kg/t) | Reduction in Copper dissolved (%) | SCN Formed (kg/t) | NaCN Consumed (kg/t) |
|---|---|---|---|---|---|
| None | 71.8 | 0.37 | — | 0.52 | 1.44 |
| Ethomeen C/12 (0.14) | 72.6 | 0.19 | 49 | 0.21 | 0.83 |
| Ethomeen T/25 (0.97) | 75.8 | 0.39 | 0 | 0.61 | 1.53 |
| Ethomeen S/12 (0.32) | 68.0 | 0.17 | 54 | 0.14 | 0.74 |
| Duoteric H/12 (1.06) | 83.5 | 0.15 | 59 | 0.19 | 0.68 |
| Duoteric H/12* (0.20) | 83.0 | 0.27 | 27 | 0.37 | 1.00 |
| Armeen O (0.10) | 75.5 | 0.28 | 24 | 0.35 | 1.14 |
| Ethoduomeen (0.5) | 81.8 | 0.23 | 38 | nd | 0.99 |

*ore ground in NaCN and then Duoteric added with more NaCN
Conditions:
HB/M (500 g); 0.42% wt Cu; 2.1 g/t gold
Reagent added in grind (25.5 min)
Pulp density of leach: 30–35% wt solids
NaCN concentration: 1.8 kg/t ore
Leach time: 72 h
pH maintained at 11–11.5 by addition of $Ca(OH)_2$

TABLE 3

MAJOR ELEMENTS IN HOPE BROOK ORE SAMPLES

| Element or Group | % wt HB/M | HB66 | HB78 | HB ROM |
|---|---|---|---|---|
| Au[3] (g/t) | 2.09 | 2.54 | 0.96 | 8.25 |
| Cu | 0.42 | 0.11 | 0.05 | 0.16 |
| Fe | 6.2 | 5.2 | 4.4 | 4.7 |
| S[2] | 1.2 | 3.9 | 3.0 | 5.0 |
| Si | 34.7 | 32.2 | 32.2 | 37.3 |
| Al | 2.1 | 1.9 | 2.4 | 0.5 |
| Chalcopyrite[4] | 1.20 | 0.31 | 0.14 | 0.46 |
| Pyrite | 2.1 | 7.3 | 5.6 | 9.3 |
| Non-sulphide iron | 4.9 | 1.7 | 1.75 | 0.2 |

Notes:
[1]determined by AAS unless otherwise stated
[2]determined by combustion
[3]determined by Fire Assay
[4]assuming all copper present as chalcopyrite and remaining sulphur present as pyrite

We claim:

1. A process for the treatment of precious metal containing ores, which contain cyanide consuming copper minerals, during cyanidation and recovery of the precious metal, the process comprising introducing an ethoxylated fatty alkyl amine into a mixture of the ore and a cyanide solution such that the amine is in contact with the ore during cyanidation.

2. A process according to claim 1 in which the fatty alkyl amine is a primary, secondary or tertiary fatty alkyl amine.

3. A process according to claim 1 in which the fatty alkyl amine is a blend of two or more of a primary, secondary, tertiary or quaternary amine.

4. A process according to claim 1 in which the fatty alkyl amine is a coco-, tallow- or oleyl-amine.

5. A process according to claim 1 in which the precious metal containing ore is a gold containing ore.

6. A process according to claim 1 in which the ore is milled after contacting it with the fatty alkyl amine.

7. A process according to claim 1 in which the ore is milled before contacting it with the fatty alkyl amine.

8. A process according to claim 1 in which the cyanide consuming copper mineral is chalcopyrite.

* * * * *